United States Patent [19]

Nilssen

[11] Patent Number: 5,003,227

[45] **Date of Patent: * Mar. 26, 1991**

[54] POWER DISTRIBUTION FOR LIGHTING SYSTEMS

[76] Inventor: Ole K. Nilssen, Caesar Dr., Barrington, Ill. 60010

[ * ] Notice: The portion of the term of this patent subsequent to Dec. 2, 2003 has been disclaimed.

[21] Appl. No.: 453,387

[22] Filed: Dec. 18, 1989

Related U.S. Application Data

[63] Continuation of Ser. No. 232,513, Aug. 15, 1988, abandoned, which is a continuation of Ser. No. 577,975, Feb. 8, 1984, abandoned.

[51] Int. Cl.[5] ..... H05B 37/00; H05B 41/00

[52] U.S. Cl. ..... 315/161; 315/312; 315/324

[58] Field of Search ..... 315/209 R, 210, 161, 315/312, 324; 362/148; 361/377; 307/82

[56] References Cited

U.S. PATENT DOCUMENTS 2,965,804 12/1960 Roesel, Jr. et al. ..... 315/324 X
3,801,865 4/1974 Roberts ..... 315/209 R X
4,293,799 10/1981 Roberts ..... 315/324 X
4,626,747 12/1986 Nilssen ..... 315/312 X

FOREIGN PATENT DOCUMENTS 633937 1/1962 Canada ..... 362/148

*Primary Examiner*—David Mis

[57] ABSTRACT

A number of power-line-operated high-frequency multi-output central power supplies are mounted at spaced-apart points on the permanent ceiling above a suspended ceiling. From each individual output of each such power supply, high frequency power is provided by way of flexible conductor means to a lighting fixture mounted nearby in the grid structure of the suspended ceiling below. Thus, high frequency power distribution is accomplished in a hub-and-spoke fashion by way of relatively short lengths of conductors—with each conductor carrying a relatively light current. Compared with the conventional bus-wire system of distributing high frequency power to a plurality of lighting fixtures, subject hub-and-spoke distribution system provides for substantially lower distribution losses and minimized radio frequency interference. Also, this hub-and-spoke system provides for more flexibility in terms of installing and positioning the fixtures in the suspended ceiling.

17 Claims, 2 Drawing Sheets

POWER DISTRIBUTION FOR LIGHTING SYSTEMS

This is a continuation of application Ser. No. 07/232,513 filed 2-8-84.

BACKGROUND OF THE INVENTION

1. Field of Invention

The present invention relates to power distribution for high-frequency lighting systems.

2. Description of Prior Art

High-frequency lighting systems have been described in several prior art references, such as for instance in U.S. Pat. No. 4,207,497 to Capewell et al, or in U.S. Pat. No. 4,207,498 to Spira et al. In all of these systems, high-frequency power is distributed in the same fashion as is conventionally done with ordinary low-frequency power supplied directly from the power line. That is, the high-frequency power is distributed from its source to the various high-frequency lighting fixtures by way of a single set of high-frequency conductors—with the fixtures connected with these conductors at spaced-apart points therealong. Thus, the conductors have to have a length that extends to the fixture that is furthermost removed from the power supply. Moreover, especially near the source, the conductors have to carry a relatively heavy current—substantially more current than is required by a single lighting fixture.

Due to skin effect, which is indeed very much in evidence at the power levels and at the 20–40 kHz frequencies typically used with high-frequency lighting systems, it is necessary—in order to keep distribution losses within acceptable levels —to provide for special and costly distribution conductors. Or, it is necessary to accept higher-than-normal distribution losses.

Also, due to the resulting relatively high product of high-frequency current and conductor length, a correspondingly high degree of radiation of radio frequency interference results.

Moreover, the conventional fixture-to-fixture or serial method of power distribution provides for a relatively inflexible relationship between the various lighting fixtures, making it particularly difficult to move on fixture relative to another.

RATIONALE OF INVENTION

In view of the background presented above, it seems advantageous to provide a power distribution system that provides high-frequency power to the various high-frequency lighting fixtures by way of a plurality of spaced-apart multi-output central power supplies—with each individual fixture being supplied by way of its own individual set of light-weight power conductors directly from a nearby central power supply, thereby providing for a hub-and-spoke or parallel distribution system.

SUMMARY OF THE INVENTION

Objects of the Invention

A first object of the present invention is that of providing improved power distribution for high-frequency lighting systems.

A second object is that of providing a high-frequency lighting system that is particularly suitable for use with suspended ceilings.

A third object is that of providing a high-frequency lighting system for suspended ceilings that offers improved flexibility in terms of fixture mounting and positioning.

These as well as other objects, features and advantages of the present invention will become apparent from the following description and claims.

BRIEF DESCRIPTION

In its preferred embodiment, subject invention constitutes a power-line-operated high-frequency lighting system for a suspended ceiling. It consists of the following principal component parts:

(a) a number of central power-line-operated high-frequency power supplies, each such central power supply being mounted on the permanent ceiling above the suspended ceiling and having a plurality of individual output receptacles, each individual output receptacle providing a high-frequency output voltage;

(b) for each central power supply and mounted in the grid of the suspended ceiling in the general area below the power supply, a plurality of high-frequency lighting fixtures (generally one lighting fixture for each of the individual output receptacles), each such lighting fixture comprising one or more lamps (H.I.D., fluorescent and/or incandescent) and a matching network operative to derive the requisite lamp operating voltages and currents from one of the power supply's individual output receptacles; and (c) for each fixture, a pair of coiled-up conductor wires adapted to provide for electrical connection between the fixture and one of the power supply's individual output receptacles.

Thus, with this lighting system, a plurality of lighting fixtures is associated with each central power supply, which is fastened on the permanent ceiling above the general area where the lighting fixtures are mounted in the suspended ceiling.

In other words, in a hub-and-spoke arrangement, each central power supply powers a plurality of lighting fixtures by way of individual conductor pairs radiating out from the central power supply to the associated plurality of lighting fixtures.

The power provided to each lighting unit is provided at a relatively high voltage and power factor; thereby permitting a maximum amount of power to be transferred at a minimum flow of current.

The conductor pairs are provided in the form of flexible coiled-up wire means, thereby permitting each individual fixture to be easily moved and/or repositioned relative to its associated central power supply.

DESCRIPTION OF THE PREFERRED EMBODIMENT

Details of System and Circuits

Figure 1:
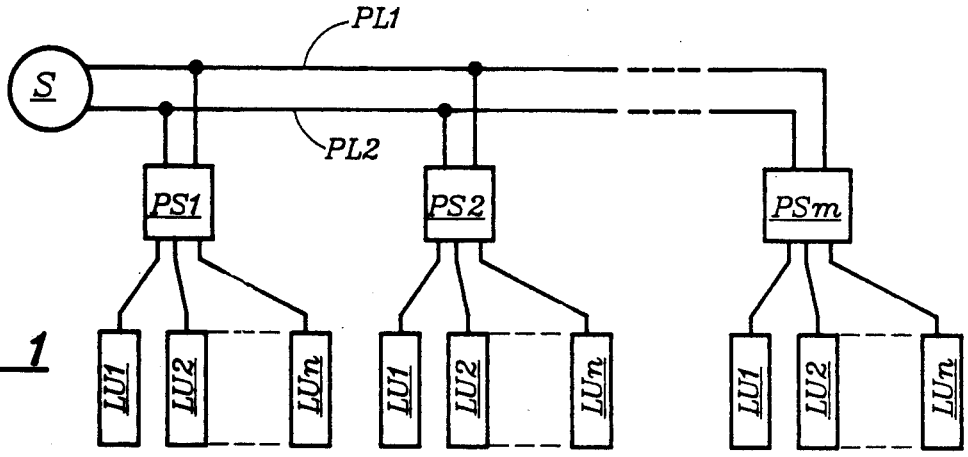
FIG. 1 schematically illustrates the preferred embodiment of the invention and shows a number of power-line-operated inverter power supplies, each providing a plurality of separate high-frequency AC voltage outputs for operation of a corresponding plurality of individual lighting fixtures.

In FIG. 1, a source S of 120 Volt/60 Hz voltage is applied to a pair of power line conductors PL1 and PL2. Connected at various points along this pair of power line conductors are a number m of central power-line-operated high-frequency multi-output power supplies PS1, PS2 --- PSm.

To each such high-frequency power supply are connected a number n of lighting units or fixtures LU1, LU2 --- LUn. (The number n may be different for different power supplies and/or at different times.)

Figure 2:
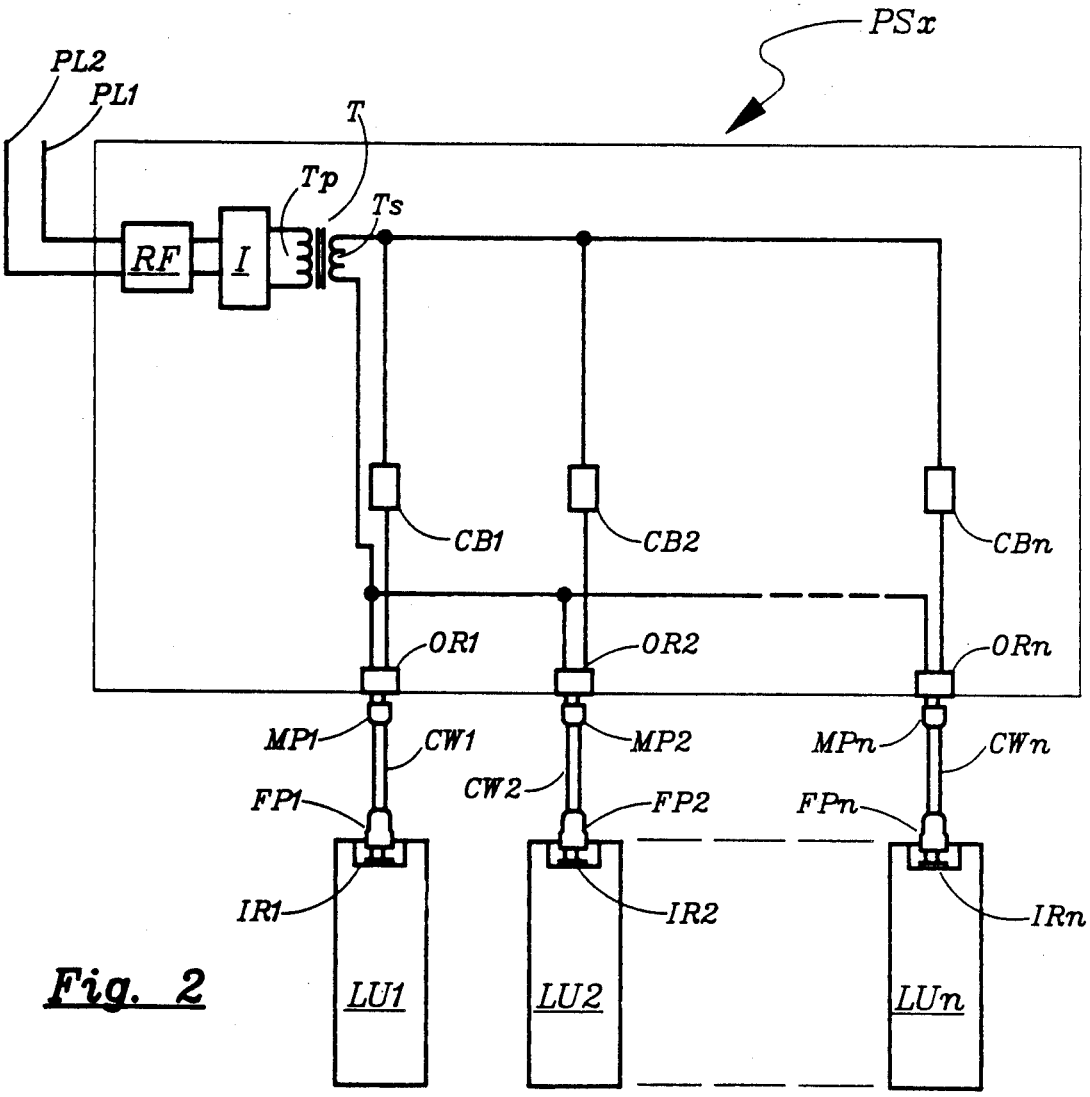
FIG. 2 schematically illustrates the preferred embodiment of one of these power supplies with its plurality of high-frequency output receptacles as well as with its individual connections to a corresponding plurality of lighting fixtures.

FIG. 2 illustrates in further detail one of the power supplies of FIG. 1 and its associated n lighting units. This one power supply is referred to as PSx, and is powered from power line conductors PL1 and PL2.

Inside PSx, power line conductors PL1 and PL2 are directly connected with a rectifier-filter combination RF, the substantially constant DC output voltage of which is applied to an inverter I.

The output from inverter I is a 30 kHz AC voltage, which AC voltage is applied to the primary winding Tp of an isolating transformer T. The output of transformer T is provided by its secondary winding Ts and is a 2OO Volt/30 kHz voltage, which high-frequency voltage is provided to each of a plurality of female output receptacles OR1, OR2 and ORn by way of circuit breakers CB1, CB2 and CBn, respectively.

By way of male plugs MP1, MP2 --- MPn, conduction wire-pairs CW1, CW2 --- CWn, and female plugs FP1, FP2 --- FPn, the female output receptacles OR1, OR2 --- ORn are connected with male input receptacles IR1, IR2 --- IRn on lighting units LU1, LU2 --- LUn, all respectively.

The assembly consisting of rectifier and filter means RF, inverter I, transformer T, circuit breakers CB1, CB2 --- CBn, and the n output receptacles OR1, OR2 --- ORn, is referred to as power supply PSx.

Figure 3:
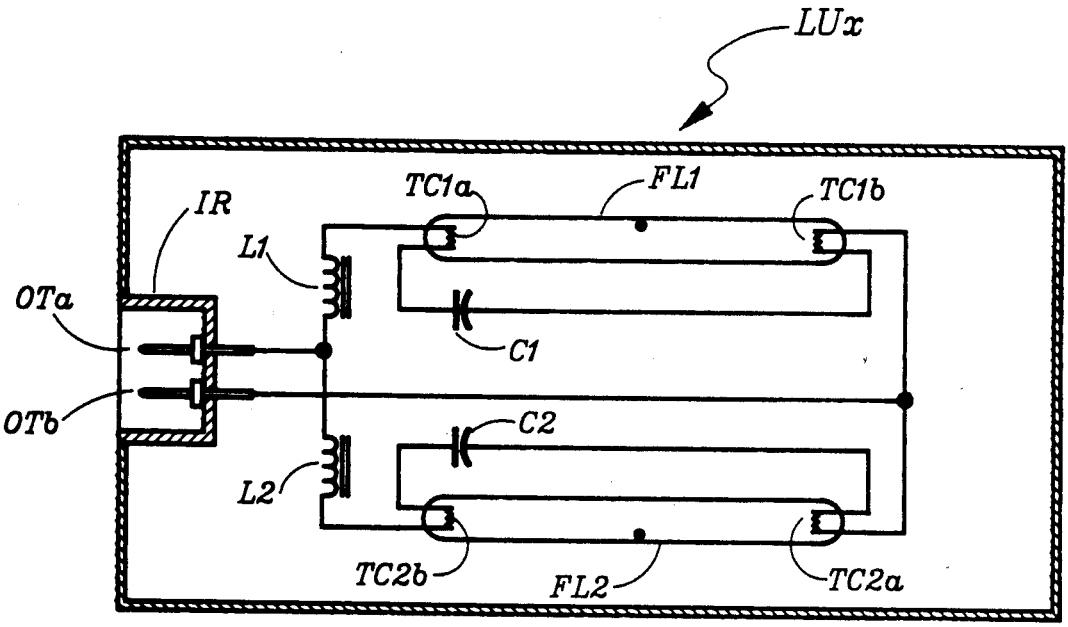
FIG. 3 schematically shows electrical circuit details of an individual fluorescent lighting fixture.

FIG. 3 illustrates one of the n lighting units referred to in FIG. 2 as LU1, LU2—LUn. This one lighting unit is referred to as LUx. It has a male power input receptacle IR, which has two output terminals OT*a* and OT*b*, and comprises a pair of fluorescent lamps FL1 and FL2, a pair of corresponding ballasting inductors L1, L2 and ballasting capacitors C1, C2.

Fluorescent lamp FL1 has two thermionic cathodes TC1*a* and TC1*b*; and fluorescent lamp FL2 has two similar cathodes TC2*a* and TC2*b*.

Inductor L1 is connected between output terminal OT*a* and one of the terminals of cathode TC1*a*. Capacitor C1 is connected between the other terminal of cathode TC1*a* and one of the terminals of cathode TC1*b*. The other terminal of cathode TC1*b* is connected with output terminal OT*b*.

Inductor L2 is connected between output terminal OT*a* and one of the terminals of cathode TC2*a*. Capacitor C2 is connected between the other terminal of cathode TC2*a* and one of the terminals of cathode TC2*b*. The other terminal of cathode TC2*b* is connected with output terminal OT*b*.

Figure 4:
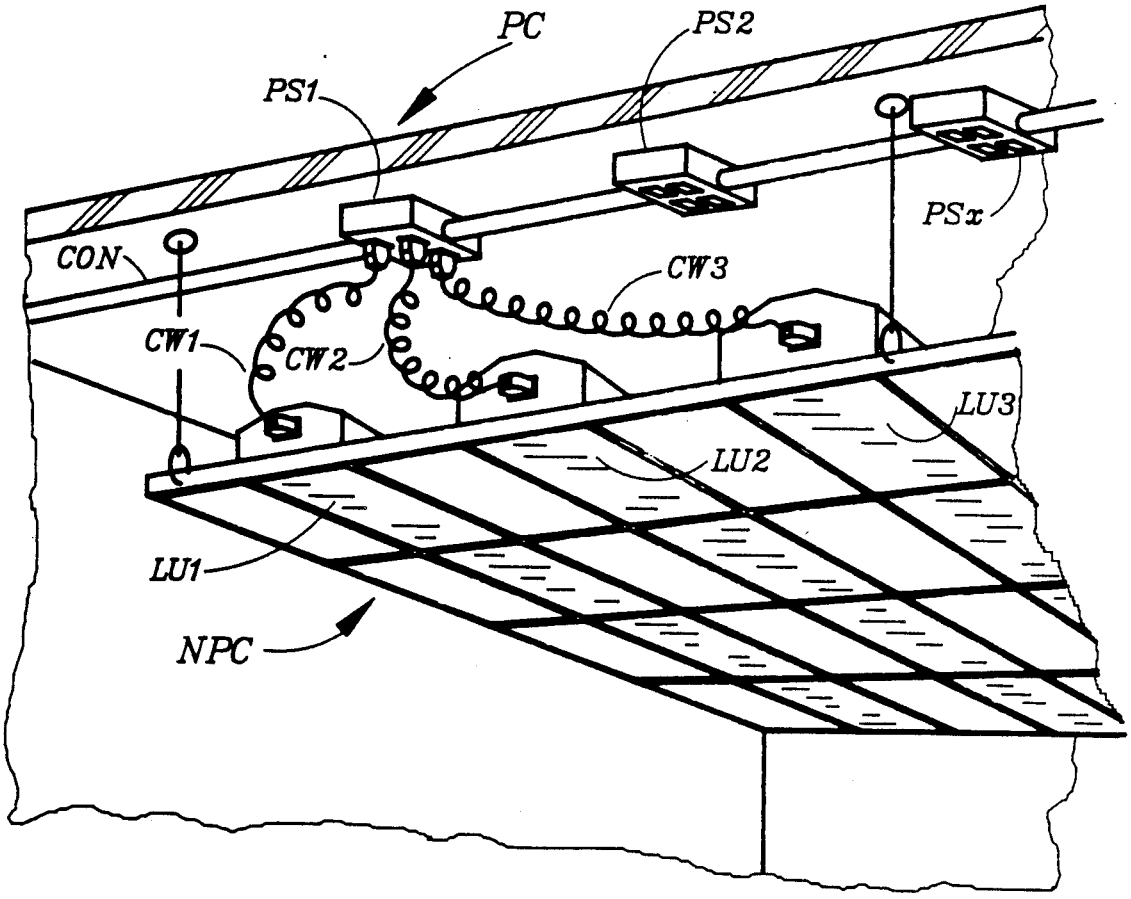
FIG. 4 installation of subject high-frequency lighting system.

FIG. 4 illustrates an expectedly typical installation in a building of subject high-frequency lighting system. The power line conductors are provided by way of conduit CON to a number of different central high-frequency multi-output power supplies PS1, PS2, and PSx.

These power supplies are mounted (in a way similar to that of regular electrical junction boxes) onto the permanent ceiling PC. Suspended from this permanent ceiling is a non-permanent ceiling NPC; which non-permanent ceiling is an ordinary so-called suspended ceiling, which has a grid structure of suspended T-bars with ceiling panels and lighting fixtures used for filling in the openings in the grid structure. For sake of clarity, the suspended ceiling is shown without the ceiling panels.

From each of the power supplies, a plurality of coiled-up cable means provide for flexible plug-in connection with a like plurality of lighting units. However, for sake of clarity, only a few connections are specifically shown: From power supply PS1, connect wires CW1, CW2 and CW3 are shown to connect with lighting units LU1, LU2 and LU3.

DESCRIPTION OF OPERATION

The operation and use of the subject high-frequency lighting system may be explained as follows.

In FIG. 1, the pair of power line conductors PL1 and PL2 provides 120 Volt/60 Hz power to each and every high-frequency power supply: PS1, PS2 --- PSm.

Each of these power supplies (Ex: PSx) converts its 12O Volt/60 Hz input voltage to a high-frequency output voltage; which output voltage is transformed by a transformer (T) to a magnitude of about 200 Volt RMS and is supplied to each one of the plurality of output receptacles (Ex: OR1). The load current flowing to each of these output receptacles passes through a circuit breaker (Ex: CB1); which provide for a limitation on the magnitude of load current that can be supplied to any given output receptacle.

The circuit breaker (CB1) is responsive to the RMS magnitude of the current flowing through it. In particular, the circuit breaker is a normally-closed thermally-activated bimetallic switcher that operates to latch itself into an open-circuit position in case the current flowing through it exceeds a certain pre-established RMS magnitude for more than a few seconds. After having latched itself into such an open-circuit position, power has to be removed to cause it to reset.

The purpose of the circuit breakers (Ex: CB1) within the various power supplies (Ex: PSx) is that of removing power from a given output receptacle (Ex: OR1) in case an excess current flows for longer than a brief period of time (i.e., for longer than about five seconds).

Thus, in case of a short-circuit or an overload condition caused by a given lighting unit (among the plurality of lighting units powered from a single power supply), the power supplied to that given lighting unit will be interrupted by way of the particular circuit breaker associated with that given lighting unit—leaving the remaining lighting units unaffected.

The fluorescent lamp ballasting arrangement shown in FIG. 3 is of a high-frequency resonant-type, and operates similarly to ballasting circuits previously described in published literature—such as, for instance, in U.S. Pat. No. 3,710,177 to Ward.

An important feature of these resonant or near-resonant ballasting circuits relates to the fact that they can be arranged to draw power from their source at a relatively high power factor. In other words, for a given current-flow, the resonant ballast provides for nearly the maximum possible power to be extracted from the source.

FIG. 4 illustrates the use and installation in a building of the high-frequency lighting system of FIG. 1, and shows three multi-output power supplies mounted on the permanent ceiling above a non-permanent suspended ceiling.

Each of these multi-output power supplies has a plurality of output receptacles; and each of these receptacles provides an independently over-current-protected output of 200 Volt/30 kHz AC voltage.

A number of lighting units of the type described in FIG. 3, but in the form of lighting fixtures, are fitted into the grid system of the suspended ceiling. Each of these fixtures is then connected by way of a coiled-up flexible cable means with one of the output receptacles of one of the central high-frequency multi-output power supplies mounted on the permanent ceiling above the grid structure.

It should be noted that—since the central multi-output power supplies provide output voltages of relatively high frequency (30 kHz or so)—the weight of the ballasting means in the fluorescent lighting fixtures (FIG. 3) can be very small; which implies that the weight of the fluorescent lighting fixtures themselves can be very small in comparison with the weight of ordinary fluorescent lighting fixtures. And, of course, the installation and/or removal of such lighter-weight lighting fixtures is easier than with the heavier fixtures.

It is believed that the present invention and its several attendant advantages and features will be understood from the preceding description. However, without departing from the spirit of the invention, changes may be made in its form and in the construction and interrelationships of its component parts, the form herein presented merely representing the preferred embodiment.

I claim:

1. A lighting system comprising:

a suspended ceiling having a grid structure;

an ordinary electric utility power line;

central power supply connected with said power line and operative to provide an AC voltage at each one of a plurality of separate outputs, the frequency of said AC voltage being substantially higher than that of the voltage on said power line;

a plurality of lighting units supported by said grid structure and located in an area proximate to said central power supply, each one of these lighting units being adapted to be properly powered from one of said separate outputs; and for each one of these lighting units, flexible connect cable operative to provide connection between this one lighting unit and one of said outputs;

whereby each of these lighting units is provided with power directly from said central power supply by way of an individual connect cable, thereby distributing power from this central power supply to these lighting units in a hub-and-spoke manner; which, in turn, minimizes distribution losses.

2. A lighting system comprising:

multiple central power supplies located at spaced-apart points in or on a ceiling structure, each one of these power supplies having a plurality of separate individual outputs, each one of these individual outputs providing an AC voltage, the frequency of this AC voltage being substantially higher than that of the voltage on an ordinary electric utility power line;

for each one central power supply, a plurality of lighting units located proximately thereto, each one of these lighting units being operable to be properly powered by the AC voltage provided from one of said outputs; and for each particular one of said lighting units, a flexible cable to provide connection between this particular one lighting unit and one of the outputs of a central power supply located proximately thereto whereby each lighting unit is individually and separately provided with power directly from one of the outputs of one of said central power supplies by way of an individual connect cable, thereby distributing power from this central power supply to these lighting units in a hub-and-spoke manner; which, in turn, minimizes distribution losses.

3. A lighting system comprising:

a suspended ceiling having a grid structure;

an ordinary electric utility power line; the maximum electric power extractable from this power line being so large as to constitute a fire initiation hazard in case of fault condition, such as a short circuit;

a number of power supplies connected with said power line; each power supply being operative to provide an AC voltage at a power output; the maximum electric power extractable from this power output being so low as not to constitute a fire initiation hazard in case of a fault condition, such as a short circuit;

plural lighting units supported by said grid structure; at least one of the lighting units being located in an area proximate to one of the power supplies; said one of the lighting units being adapted to be properly powered from the power output of said one of the power supplies; and for each one of the plural lighting units, a flexible connect cable operative to provide disconnectable connection between said at least one of the lighting units and said one of the power supplies located proximate thereto;

whereby each one of the plural lighting units is disconnectably connected with and powered from a power supply located proximate thereto, thereby to minimize distribution losses.

4. The lighting system of claim 3 wherein the flexible connect cable includes a plug means having electrically conductive prongs adapted to be inserted into and held by an electrical receptacle means.

5. The lighting system of claim 3 wherein: (i) the ordinary electric utility power line includes a power line conductor; (ii) a person coming in electrical contact with this power line conductor is apt to receive a hazardous electric shock if also, at the same time, being in electrical contact with earth ground; (iii) each of the power supplies includes electrical shock prevention means; (iv) said power output includes an output electrode; and (v) a person coming in electrical contact with this output electrode is, due to the electrical shock prevention means, prevented from receiving a hazardous electric shock even if also, at the same time, being in electrical contact with earth ground.

6. The lighting system of claim 4 wherein (i) the ordinary electric utility power line includes a power line conductor; (ii) a person coming in electrical contact with this power line conductor is apt to receive a hazardous electric shock if also, at the same time, being in electrical contact with earth ground; (iii) each of the power supplies includes electrical shock prevention means; (iv) said power output includes an output electrode; and (v) a person coming in electrical contact with this output electrode is, due to the electrical shock prevention means, prevented from receiving a hazardous electric shock even if also, at the same time, being in electrical contact with earth ground.

7. The lighting system of claim 6 wherein the electric shock prevention means includes an isolation transformer.

8. The lighting system of claim 3 wherein each of the plural lighting units includes: (i) a pair of input terminals; (ii) a gas discharge lamp having a pair of lamp terminals across which there exists a lamp voltage; and (iii) conditioning means connected in circuit between the input terminals and the lamp terminals, the conditioning means being operative to permit the magnitude of the lamp voltage to be different from that of an input voltage provided between the input terminals.

9. The lighting system of claim 3 wherein the ordinary electric utility power line provides an AC voltage to each of said number of power supplies.

10. The lighting system of claim 3 wherein: (i) at least one of said number of power supplies may at certain times be connected with said power line while at the same time not have any load connected with its power output; and (ii) the amount of power drawn by said at least one power supply from the power line is very much smaller during said certain times than it is during times when a load is indeed connected with the power output of said at least one power supply.

11. The lighting system of claim 3 wherein said power supplies are located at spaced-apart points along a pair of power line conductors.

12. The lighting system of claim 3 wherein said power supplies are mounted at or on a permanent ceiling above the suspended ceiling.

13. The lighting system of claim 3 wherein each one of said plural lighting units is adapted to be properly powered from the power output of one of the power supplies by way of only two electrical conductors.

14. The lighting system of claim 3 wherein each one of said plural lighting units includes: (i) a pair of input terminals; (ii) a gas discharge lamp having a pair of thermionic cathodes, each having a pair of cathode terminals; and (iii) connect and matching means connected in circuit between the two input terminals and the four cathode terminals, the connect and matching means being operative to provide proper operating voltages to and between the termionic cathodes;

such that the gas discharge lamp, including its thermionic cathodes, is properly operated even though supplied with power by way of no more than two input terminals.

15. A lighting system comprising:

a suspended ceiling having a grid structure;

an ordinary electric utility power line; the maximum electric power extractable from this power line being so large as to constitute a fire initiation hazard in case of a fault condition, such as a short circuit;

plural power supplies connected with said power line; each of the plural power supplies being operative to provide an AC voltage at a power output; the maximum electric power extractable from this power output being so low as not to constitute a fire initiation hazard in case of a fault condition, such as a short circuit;

plural lighting units supported by said grid structure; at least one of the lighting units being located in an area proximate to one of the power supplies; said one of the lighting units being adapted to be properly powered from the power output of said one of the power supplies; and for each one of the plural lighting units, a flexible connect cable operative to provide disconnectable connection between said at least one of the lighting units and said one of the power supplies located proximate thereto;

whereby each one of the plural lighting units is disconnectably connected with and powered from a power supply located proximate thereto, thereby to minimize distribution losses.

16. A lighting system comprising;

an ordinary electric utility power line; the maximum electric power extractable from this power line being so large as to constitute a fire initiation hazard in case of a fault condition, such as a short circuit;

a number of power supplies connected with said power line; each power supply being operative to provide an AC voltage at a power output; the maximum electric power extractable from this power output being so low as not to constitute a fire initiation hazard in case of a fault condition, such as a short circuit;

plural lighting units mounted in proximity of the ceiling in a room; each given one of the lighting units being located proximate to a given one of the power supplies; said given one of the lighting units being adapted to be properly powered from the power output of said given one of the power supplies; and for each given one of the lighting units, a flexible connect cable operative to provide disconnectable connection between said given one of the lighting units and said given one of the power supplies located proximate thereto;

whereby each one of the lighting units is disconnectably connected with and powered from a power supply located proximate thereto, thereby to minimize distribution losses.

17. A lighting system comprising:

an ordinary electric utility power line; the maximum electric power extractable from this power line being so large as to constitute a fire initiation hazard in case of a fault condition, such as a short circuit;

plural power supplies connected with said power line; each power supply being mounted on or in a ceiling structure of a room and operative to provide an AC voltage at a power output; the maximum electric power extractable from this power output being so low as not to constitute a fire initiation hazard in case of a fault condition, such as a short circuit;

plural lighting units also mounted on or in the ceiling structure such that each one of the lighting units being located proximate to one of the power supplies; the lighting units each being adapted to be properly powered from the power output of one of the power supplies; and for each of the lighting units, a flexible connect cable operative to provide disconnectable connection between said given one of the lighting units and one of the power supplies located proximate thereto, thereby to minimize distribution losses.

* * * * *